US011737185B2

(12) United States Patent
Zhanxiang et al.

(10) Patent No.: US 11,737,185 B2
(45) Date of Patent: Aug. 22, 2023

(54) LED CONTROL SYSTEM USING MODULATED SIGNAL

(71) Applicant: Jiangsu Caihuixin Electronic Technology Co., Ltd., Shanghai (CN)

(72) Inventors: Wang Zhanxiang, Shanghai (CN); Weng Shengying, Putian (CN); Kailang Huang, Dongguan (CN)

(73) Assignee: Jiangsu Caihuixin Electronic Technology Co., Ltd., Shanghai (CN)

( * ) Notice: Subject to any disclaimer, the term of this patent is extended or adjusted under 35 U.S.C. 154(b) by 126 days.

(21) Appl. No.: 17/406,484

(22) Filed: Aug. 19, 2021

(65) Prior Publication Data

US 2022/0061136 A1 Feb. 24, 2022

Related U.S. Application Data

(60) Provisional application No. 63/067,600, filed on Aug. 19, 2020.

(51) Int. Cl.

| | |
|---|---|
| ***H05B 45/24*** | (2020.01) |
| ***H05B 45/3725*** | (2020.01) |
| ***H05B 45/34*** | (2020.01) |
| ***H05B 45/325*** | (2020.01) |

(52) U.S. Cl.

CPC ..... *H05B 45/24* (2020.01); *H05B 45/325* (2020.01); *H05B 45/34* (2020.01); *H05B 45/3725* (2020.01)

(58) Field of Classification Search

CPC ..... H05B 45/34; H05B 45/3725

See application file for complete search history.

(56) References Cited

U.S. PATENT DOCUMENTS

| | | | | |
|---|---|---|---|---|
| 8,134,299 | B2 | 3/2012 | Peng | |
| 8,450,944 | B2 * | 5/2013 | Joseph | H05B 47/185 315/307 |
| 8,884,535 | B2 * | 11/2014 | Peng | H05B 45/46 315/318 |

(Continued)

FOREIGN PATENT DOCUMENTS

| | | |
|---|---|---|
| CN | 104363680 | 2/2015 |
| CN | 204180343 | 2/2015 |

(Continued)

*Primary Examiner* — Abdullah A Riyami
*Assistant Examiner* — Syed M Kaiser
(74) *Attorney, Agent, or Firm* — Joseph A. Andelin; Fish IP Law, LLP

(57) ABSTRACT

The present invention discloses lamp bead chipsets and colored lamp devices. The colored lamp device includes a power off signal controller and several lamp bead chipsets connected in series and/or in parallel. The power off signal controller generates power supply signals having alternating high and low levels and different high level widths, and load the power supply signals onto a power cord and a ground wire. The lamp bead chipset controls the display state of each LED in an LED lamp set according to the different high level widths and output on the power cord and the ground wire. Several power supply high level widths on the power cord and the ground wire are adjusted to generate codes, so as to achieve different color change effects. The lamp bead chipsets and colored lamp devices described herein reduce the complexity of traces and the wire costs.

10 Claims, 8 Drawing Sheets

(56) References Cited

U.S. PATENT DOCUMENTS

| | | | | |
|---|---|---|---|---|
| 8,928,233 | B1 | 1/2015 | Peng | |
| 9,060,395 | B1 | 6/2015 | Peng | |
| 9,173,259 | B1 | 10/2015 | Peng | |
| 9,723,679 | B2 | 8/2017 | Luo | |
| 10,129,959 | B2 | 11/2018 | Luo | |
| 2009/0195164 | A1* | 8/2009 | Joseph | H05B 47/185 315/209 R |
| 2012/0229045 | A1* | 9/2012 | Kikuchi | H05B 45/10 315/224 |
| 2019/0313503 | A1* | 10/2019 | Woytowitz | H05B 45/20 |
| 2021/0329762 | A1* | 10/2021 | Liu | H05B 45/18 |

FOREIGN PATENT DOCUMENTS

| | | | | | |
|---|---|---|---|---|---|
| CN | 104780686 | | | 7/2015 | |
| CN | 105722270 | | | 6/2016 | |
| CN | 105722270 | A | * | 6/2016 | |
| CN | 104507218 | | | 3/2017 | |
| CN | 208046960 | U | * | 11/2018 | |
| CN | 209328494 | U | * | 8/2019 | G09G 3/2096 |
| JP | 2019067772 | A | * | 4/2019 | |
| WO | WO-2016176063 | A1 | * | 11/2016 | H05B 45/24 |

* cited by examiner

LED CONTROL SYSTEM USING MODULATED SIGNAL

This application claims priority to U.S. Provisional Application No. 63/067,600, filed Aug. 19, 2020. All extrinsic materials identified herein are incorporated by reference in their entirety.

FIELD OF THE INVENTION

The field of the invention is colored lamp drive communications, in particular, colored lamp devices comprising lamp bead chipsets.

BACKGROUND

The background description includes information that may be useful in understanding the present invention. It is not an admission that any of the information provided herein is prior art or relevant to the presently claimed invention, or that any publication specifically or implicitly referenced is prior art.

When preparing the product of strips of a colored lamp drive device, an ordinary packaged colorful controllable LED lamp bead constantly has three or more lead wires. Taking an LED lamp bead having three lead wires as an example, the LED lamp bead includes one signal line, one power cord, and one ground wire. In this way, three wires are required for preparing the strips. The production cost is high, and traces are also complex.

SUMMARY OF THE INVENTION

The inventive subject matter provides apparatus, systems, and methods in which a lamp bead chipset is configured to achieve various colored lamp effects according to power supply signals having several different high level widths on two power cords.

In order to solve the technical problem, the present invention provides a lamp bead chipset, including a power cord and a ground wire which are led out, a driver IC unit, and an LED lamp set constituted by one or more LEDs.

The power cord and the ground wire are respectively connected to the driver IC unit, and an output end of the driver IC unit is connected to the LED lamp set.

The power cord and the ground wire are configured to load power supply signals having alternating high and low levels and different high level widths, so that the driver IC unit switches between power supply and power off.

The driver IC unit is configured to control, according to the power supply signals having several different high level widths and output on the power cord and the ground wire, the display state of each LED in the LED lamp set so as to achieve various colored lamp effects.

Furthermore, the driver IC unit includes a voltage stabilizing unit, a discharge resistor, an MCU control unit, a power off memory unit, a PWM unit, and a luminance driver circuit.

The voltage stabilizing unit is configured to perform voltage stabilizing on a power supply connected to the power cord and the ground wire so as to supply power to the driver IC unit and the LED lamp set.

The discharge resistor is connected between the power cord and the ground wire, and is configured to rapidly discharge the power supply in a power off period.

The power off memory unit is configured to memorize, in the power off period, a high level width in a power supply period which is previously recorded.

The MCU control unit is configured to record the high level width in the power supply period, and output corresponding different drive signals to the PWM unit according to the several different high level widths.

The PWM unit is configured to output corresponding different PWM waveform drive signals according to the different drive signals.

The luminance driver circuit is configured to output control signals to the LED lamp set according to the different PWM waveform drive signals to control the display state of each LED in the LED lamp set.

Accordingly, the present invention further provides a control method for a lamp bead chipset, including the following process:

- in response to a power supply and power off switch state formed by alternating high and low levels on a power cord and a ground wire, recording the current high level width in a power supply period, and memorizing the previously recorded high level width in a power off period;
- recording the high level width of a preset coding bit for corresponding times, and then decoding the high level widths to obtain a code value of the corresponding bit; and
- controlling, according to a colored lamp effect corresponding to the code value, the display state of LED chips in an LED lamp set to achieve the colored lamp effects.

Furthermore, the power off time ranges from 20 us to 1 ms, and the power supply time ranges from 1 ms to 25 ms.

Furthermore, at the beginning of power supply, if a power supply high level width change signal is not received temporarily, a test mode runs to make the LED chipset emit white light or other combinations.

Furthermore, the coding bit can be any value.

Furthermore, the coding bit includes 7-bit code, 8-bit code, 10-bit code, 12-bit code, or 14-bit code.

Furthermore, the decoding the high level widths includes determining, according to the power supply high level widths, that the code is 0, 1, or invalid.

Accordingly, the present invention further provides a colored lamp device, including a power off signal controller and several lamp bead chipsets connected in series, in parallel or in series and in parallel.

An output end of the power off signal controller is connected to the lamp bead chipset by means of a power cord and a ground wire.

The power off signal controller is configured to generate power supply signals having alternating high and low levels and different high level widths, and load the power supply signals onto the power cord and the ground wire to control the lamp bead chipset to switch between power supply and power off.

The lamp bead chipset is configured to achieve various colored lamp effects according to the power supply signals having several different high level widths and output on the power cord and the ground wire.

Furthermore, the power off signal controller includes a direct current power supply, an NMOS transistor, and a control circuit for controlling an NMOS switch. The direct current power supply is connected to the power cord of the lamp bead chipset. A base of the NMOS transistor is connected to the control circuit. A drain of the NMOS transistor is connected to the ground wire of the lamp bead chipset. A source of the NMOS transistor is grounded. A capacitor is connected in parallel between the drain and the source of the NMOS transistor.

Accordingly, the present invention further provides a control method for a colored lamp device, including the following process:

a power off signal controller generates power supply signals having alternating high and low levels and different high level widths, and loads the power supply signals onto a power cord and a ground wire;

a driver IC unit records the current high level width in a power supply period according to a power supply and power off switch state formed by the alternating high and low levels on the power cord and the ground wire, and memorizes the previously recorded high level width in a power off period;

after recording the high level width of a preset coding bit for corresponding times, the driver IC unit decodes the high level widths to obtain a code value of the corresponding bit; and the driver IC unit controls, according to a colored lamp effect corresponding to the code value, the display state of each LED chip in an LED lamp set to achieve the colored lamp effects.

Compared with the prior art, the beneficial effects achieved by the present invention are as follows: in the present invention, several power supply high level widths on the power cord and the ground wire are adjusted to generate codes, so as to achieve different color change effects. The complexity of traces is reduced and the wire costs are saved. The present invention is applied to different decorative lamps such as high and low voltage strips, water pipe lamps, copper wire lamps, curtain lamps, and net lamps. On the other hand, all lamp bead chipsets are integrated in a colorful LED lamp bead so that a peripheral control circuit becomes easier and has a small size.

Various objects, features, aspects and advantages of the inventive subject matter will become more apparent from the following detailed description of preferred embodiments, along with the accompanying drawing figures in which like numerals represent like components.

DETAILED DESCRIPTION OF THE INVENTION

The following discussion provides many example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

Figure 1:
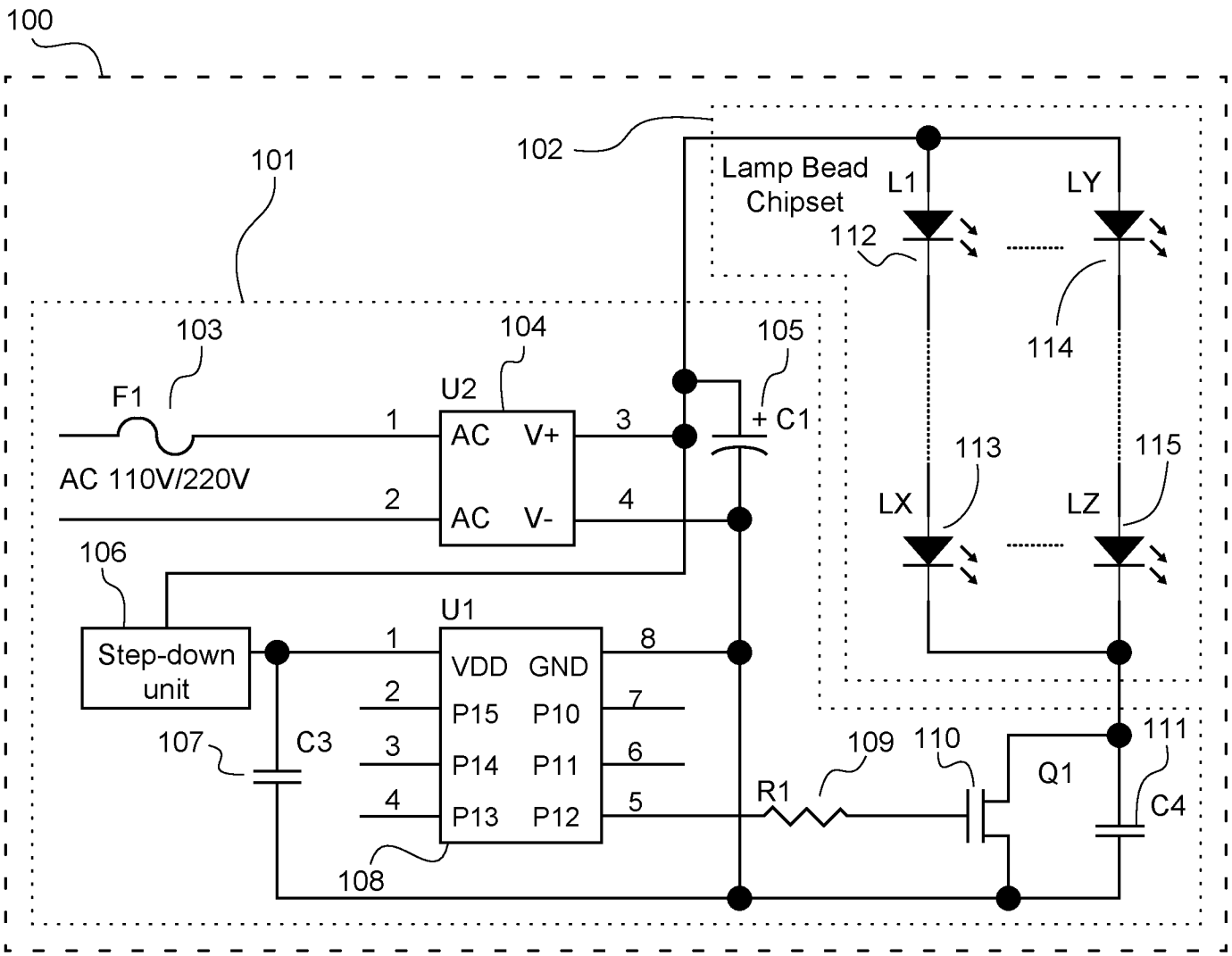
FIG. 1 is a schematic structural diagram of a colored lamp device for a high voltage application.

FIG. 1 shows a schematic structural diagram of a colored lamp device for a high voltage application comprising: colored lamp device 100, power off signal controller 101, multiple lamp bead chipsets 102, fuse F1 103, bridge rectifier U2 104, capacitor C1 105, step-down unit 106, capacitor C3 107, microcontroller chip U1 108, resistor R1 109, NMOS transistor Q1 110, capacitor C2 111, lamp bead chipset L1 112, lamp bead chipset LX 113, lamp bead chipset LY 114, and lamp bead chipset LZ 115.

Figure 2:
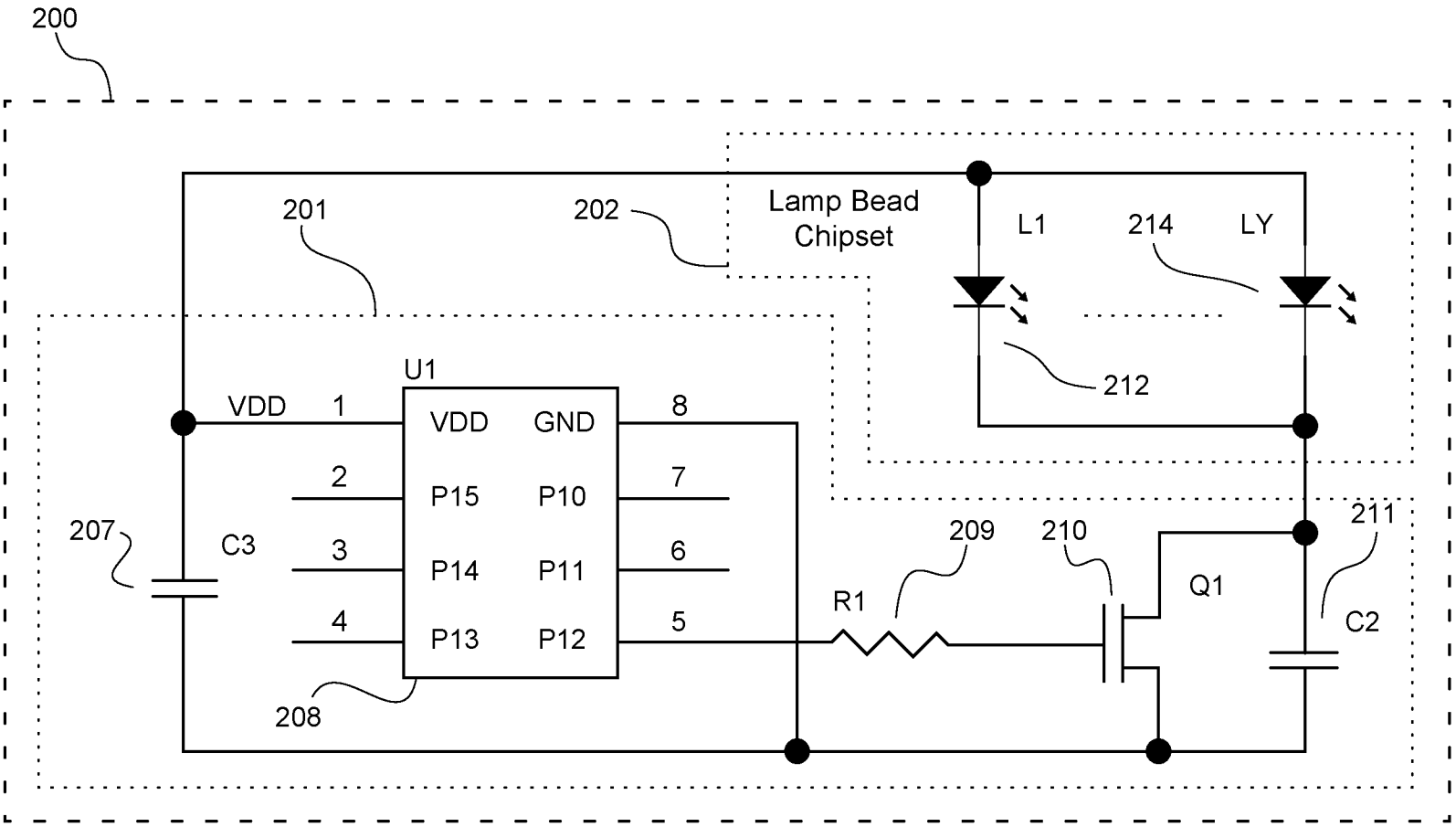
FIG. 2 is a schematic structural diagram of a colored lamp device for a low voltage application.

FIG. 2 shows a schematic structural diagram of a colored lamp device for a low voltage application comprising: colored lamp device 200, power off signal controller 201, multiple lamp bead chipsets 202, capacitor C3 207, microcontroller chip U1 208, resistor R1 209, NMOS transistor Q1 210, capacitor C2 211, lamp bead chipset L1 212, and lamp bead chipset LY 214.

Figure 3:
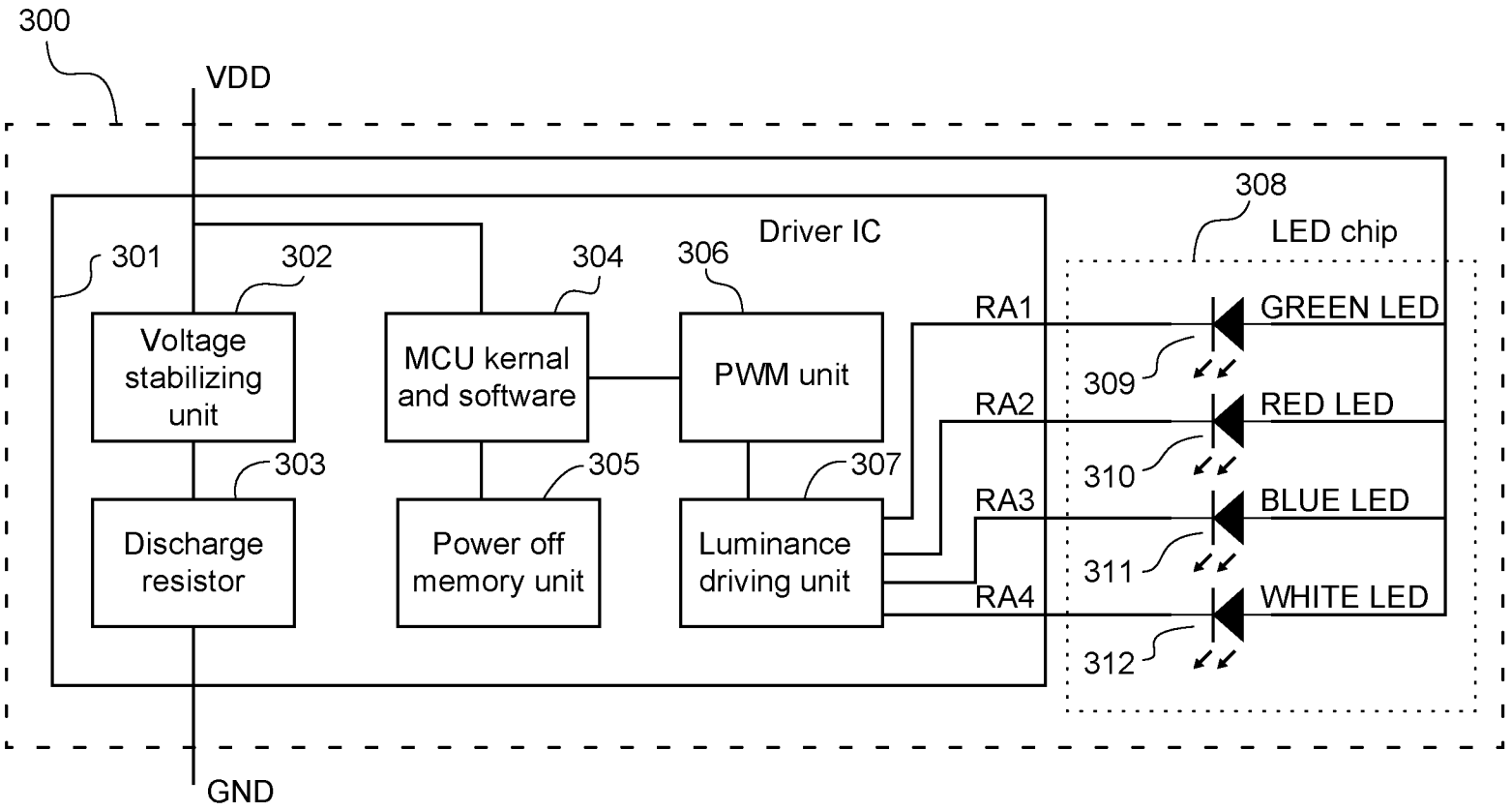
FIG. 3 is a structural diagram of a lamp bead chip set.

FIG. 3 shows a structural diagram of a lamp bead chipset comprising: lamp bead chipset 300, driver IC unit 301, voltage stabilizing unit 302, discharge resistor 303, MCU control unit 304, power off memory unit 305, PWM unit 306, luminance driving unit 307, LED lamp set 308, GREEN LED 309, RED LED 310, BLUE LED 311, WHITE LED 312.

Figure 4A:
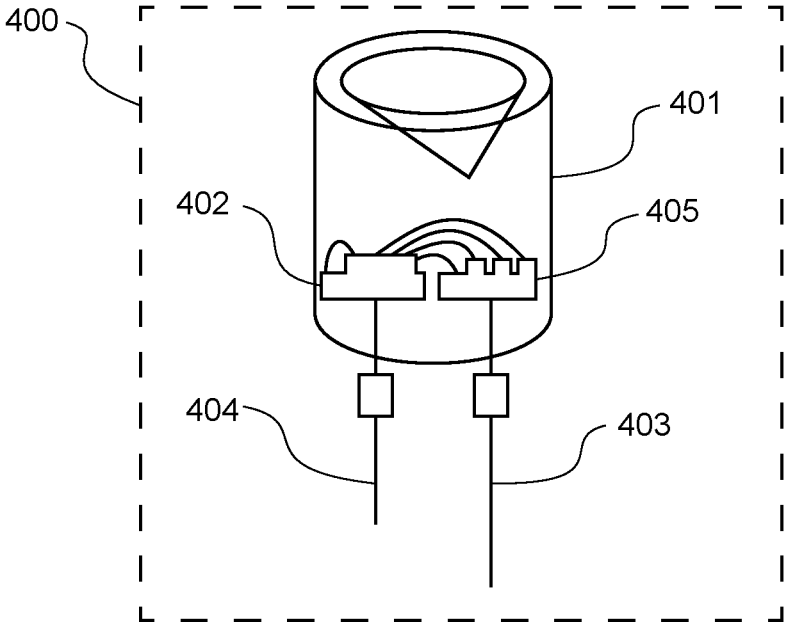
FIG. 4A is an in-line package of a lamp bead.

FIG. 4A shows an in-line package of a lamp bead comprising: in-line package lamp bead 400, housing 401, driver IC unit 402, power cord 403, ground wire 404, LED chip 405.

Figure 4B:
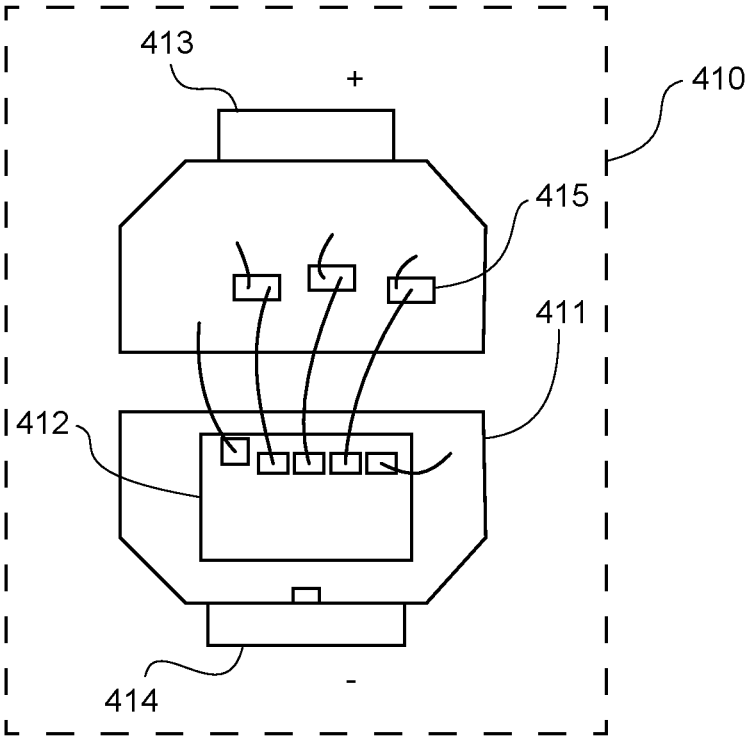
FIG. 4B is a surface mount package of a lamp bead.

FIG. 4B shows a surface mount package of a lamp bead comprising: surface mount package lamp bead 410, housing 411, driver IC unit 412, power cord 413, ground wire 414, LED chip 415.

Figure 5:
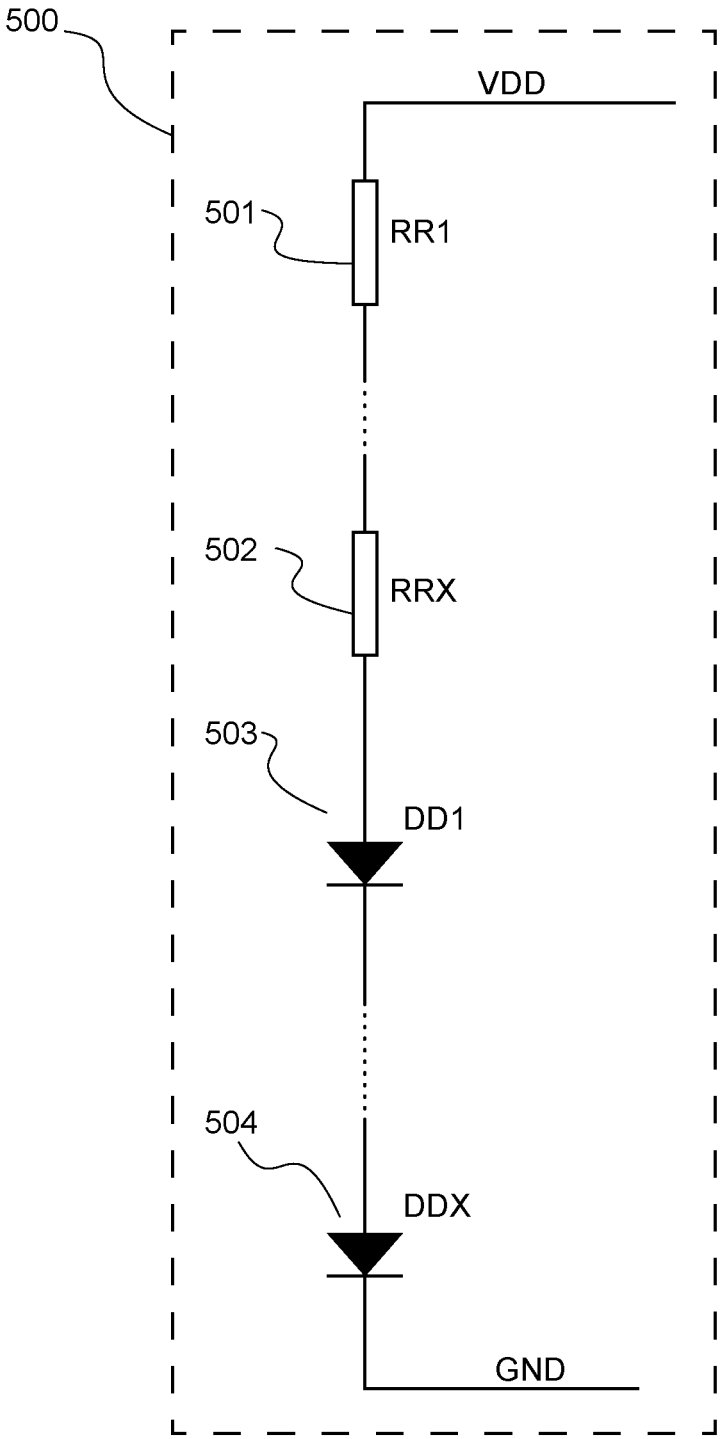
FIG. 5 is a structural diagram of a voltage stabilizing unit.

FIG. 5 shows a structural diagram of a voltage stabilizing unit comprising: voltage stabilizing unit 500, resistor RR1 501, resistor RRX 502, voltage stabilizing transistor DD1 503, voltage stabilizing transistor DDX 504.

A lamp bead chipset according to the present invention includes a power cord and a ground wire which are led out, a driver IC unit, and an LED lamp set constituted by one or more LEDs.

The power cord and the ground wire are respectively connected to an input end of the driver IC unit, and an output end of the driver IC unit is connected to the LED lamp set.

The power cord and the ground wire are configured to load power supply signals having alternating high and low levels and different high level widths, so that the driver IC unit switches between power supply and power off.

The driver IC unit is configured to control, according to the power supply signals having several different high level widths and output on the power cord and the ground wire, the display state of each LED in the LED lamp set so as to achieve various colored lamp effects.

Embodiment 1

In the embodiments of the present invention, with reference to FIG. 3, a lamp bead chipset 300 according to the present invention, including a driver IC unit 301 and an LED lamp set 308 connected to each other, and a power cord (VDD) and a ground wire (GND), which are two power cords for respectively powering on and powering off, and implementing communications (different high level widths are communication codes). An LED set is selectively connected to one to four LEDs according to the number of output ports of the driver IC unit 301. A single LED is an LED chip of different available colors such as red, green, blue, white, and warm white. An LED lamp set is a combination of LED chips of different colors.

In the embodiments of the present invention, the driver IC unit 301 includes a voltage stabilizing unit 302, a discharge resistor 303, an MCU control unit 304, a power off memory unit 305, a PWM unit 306, and a luminance driver circuit 307. The components are described in details below.

A positive electrode of the voltage stabilizing unit 302 is connected to the power cord, and a negative electrode of the voltage stabilizing unit 302 is connected to the ground wire. The voltage stabilizing unit 302 is configured to perform voltage stabilizing on a power supply connected to the power cord and the ground wire so as to supply power to the driver IC unit 301 and the LED lamp set 308. A circuit diagram of the voltage stabilizing unit is shown in FIG. 5. A voltage stabilizing unit 500 includes several resistors and several voltage stabilizing transistors connected in series. The several resistors include a total of n resistors of resistor RR1 501, . . . , resistor RRX 502, etc. The several voltage stabilizing transistors include a total of n voltage stabilizing transistors of voltage stabilizing transistor DD1 503, . . . , DDX 504, etc. The value of n can be selected according to the luminance required for an LED. The voltage stabilizing unit can evenly allocate the high voltage of the power supply to lamp bead chipsets (112, 113, 114, 115), etc. when lamp beads are cascaded. For example, the total voltage connected between the power cord and the ground wire is 165v, and 50 lamp bead chipsets are connected in series, then 3.3v is allocated to each lamp bead chipset in average. Each lamp bead chipset can balance the power supply voltage between 3v and 4v. The color difference in the color of driving lamp beads is small.

The driver IC unit 301 includes a discharge resistor 303. The discharge resistor is connected between the power cord and the ground wire, achieves rapid discharge in the power off period (when the NMOS transistor is off), and facilitates the stable operation of the driver IC unit.

An output end of the power off memory unit 305 is connected to the MCU control unit 304. The power off memory unit 305 is configured to memorize, in the power off period, a high level width (or called as the duration) in a power supply period which is previously recorded, so that the MCU control unit decodes according to the high level width, and the long-term memory without power supply is achieved.

The MCU control unit 304 is achieved by using a self-developed MCU chip, and includes a program counter, a read-only memory, an instruction decoder, an arithmetic unit, an oscillator, a time sequence generator, a timing counter, a watchdog timer, a flag register, a power on/power off reset circuit, a data register, and an input/output port controller. The MCU control unit 304 is configured to output, according to the power supply signals having several different high level widths and output on the power cord and the ground wire, different drive signals to the PWM unit and the luminance driving unit to control the display state of each LED in the LED lamp set so as to achieve coding/decoding and complex colored lamp change functions. For example, static, colorful, fading, waving, colorful gradient, random burst flash, random star flash, breathing flash, etc. colored lamp changes are achieved.

The PWM unit 306 outputs different PWM drive signals. The luminance driver circuit 307 can output control signals according to different PWM drive signals to drive the LED lamp set to achieve different display states of the LEDs, for example, outputting a high level, a low level, a PWM waveform, etc. to realize the diversification of color and luminance. One LED has one color, but has infinite luminance, which can be low or high such as light red and bright red. The minimum luminance of 1/4096 can be changed each time so that the change in 4,096 colors is achieved. The same applies to red, green, blue, white or combination colors.

In one embodiment of the present invention, a driver IC unit (a luminance driver circuit) can be selectively connected to four output ports RA1, RA2, RA3, and RA4. An LED set 308 can include GREEN LED 309, RED LED 310, BLUE LED 311, and WHITE LED 312. Negative electrodes of the LED chips are accordingly connected to pins RA1, RA2, RA3, and RA4 of the driver IC unit 301, respectively. Positive electrodes of the LEDs are connected to a positive electrode VDD of the driver IC unit 301. When RA1-RA4 of the driver IC unit 301 output a high level VDD, the corresponding LEDs do not emit light. When RA1-RA4 of the driver IC unit 301 output a low level GND, the corresponding LED chips emit light of the corresponding color.

The lamp bead chipset in the present invention can be applied to different decorative lamps such as high and low voltage strips, water pipe lamps, copper wire lamps, curtain lamps, and net lamps.

Embodiment 2

A control method for a lamp bead chipset according to the present invention, including the following process:

At step one, in response to a power supply and power off switch state formed by alternating high and low levels on a power cord and a ground wire, the high level width is recorded in the power supply period, and the previously recorded high level width is memorized in the power off period.

The power supply time and the power off time of the lamp bead chipset can be determined by a specific application, and have wide optional ranges. It is easy to code and decode. In the embodiments of the present invention, the power off time is optional between 20 us and 1 ms. The power supply time is determined according to the coding requirement, and is optional between 1 ms and 25 ms. The value ranges of the power off time and the power supply time provided in the present invention are examples, and are not intended to limit the scope of protection of the present invention.

In the preferred embodiments of the present invention, a test mode is built in an MCU control unit. After a lamp bead chipset is powered on, if a power supply high level width change signal is not received temporarily (which indicates that no communication code is included on a power cord), the test mode runs to make an LED chipset bright white or in other combinations. When the communication control is not required, it is convenient to detect the quality of a lamp bead.

At step two, high level widths of a preset coding bit are recorded for corresponding times, and then are decoded to obtain a code value of the corresponding bit.

The coding includes complex codes such as optional function, optional speed/luminance, and optional color. According to the function difference, the coding bit is variable and can be any integer. In the embodiments of the present invention, in order to achieve the timeliness of response, the coding bit is selected from 7-bit code, 8-bit code, 10-bit code, 12-bit code, and 14-bit code.

Upon receipt of a power supply and power off change signal, it is further determined whether high level widths of the complete number of coding bits are received. If the coding bit is incomplete, check and recording are carried out again until the high level widths of the complete number of bits are obtained. It is determined, according to the power supply high level widths, that the code is 0, 1, or invalid, and the high level widths are decoded to obtain a code value of the corresponding bit.

At step three, the display state of LED chips is controlled according to a colored lamp effect corresponding to the code value to achieve the colored lamp effects.

Different codes have one-to-one correspondence to colored lamp change effects. For example, the colored lamp change effect includes static, colorful, fading, waving, colorful gradient, random burst flash, random star flash, breathing flash, etc. colored lamp changes. After the code values are obtained, the display state of LED chips is controlled according to a colored lamp effect corresponding to the code value to display the colored lamp effects.

In conclusion, according to the lamp bead chipset in the present invention, several power supply high level widths on the power cord and the ground wire before power off are adjusted to generate codes, so as to achieve different colored lamp effects. The complexity of traces is reduced and the wire costs are saved.

Embodiment 3

According to different packages, a lamp bead chipset includes an in-line lamp bead and a surface mount lamp bead. Different lamp bead packages are different from package forms of the selected different LED chips and different driver IC versions. FIG. 4A in FIG. 4 is an in-line package lamp bead, and FIG. 4B is a surface mount package lamp bead.

In one embodiment, an in-line package lamp bead is as shown in FIG. 4A. An in-line package lamp bead 400 includes a housing 401 in which a driver IC unit 402, an LED chip 405 (or an LED lamp set) which is electrically connected to the driver IC unit 402 and is of optional colors such as red, green, blue, white, and warm white, and a power cord 403 and a ground wire 404 led out by positive and negative electrodes of the driver IC unit 402 are packaged. The ground wire 404 or the power cord 403 is powered off to realize coding so as to control the state of a lamp bead chipset. The driver IC unit 402 is integrated in the lamp bead so that a peripheral control circuit becomes easier.

A surface mount package lamp bead is as shown in FIG. 4B, and is similar to the in-line package lamp bead 400. A surface mount package lamp bead 410 includes a housing 411 in which a driver IC unit 412 having the power off memory and generating coding and decoding by means of the high level width, an LED chip 415 (or an LED lamp set) which is electrically connected to the driver IC unit 412 and is of optional colors such as red, green, blue, white, and warm white, and a power cord 413 and a ground wire 414 led out by positive and negative electrodes of the driver IC unit 412 are packaged. The ground wire 414 or the power cord 413 is powered off to realize coding so as to control the state of a lamp bead chipset.

All lamp bead chipsets in the present invention are integrated and packaged in a housing so that a peripheral control circuit becomes easier and has a small size.

Embodiment 4

Accordingly, the present invention further provides a colored lamp device, including a power off signal controller and several lamp bead chipsets connected in series, in parallel or in series and in parallel.

An output end of the power off signal controller is connected to the lamp bead chipset by means of a power cord and a ground wire.

The power off signal controller is configured to generate power supply signals having alternating high and low levels and different high level widths, and load the power supply signals onto the power cord and the ground wire to control power supply and power off of the lamp bead chipset.

The lamp bead chipset is configured to achieve various colored lamp effects according to the power supply signals having several different high level widths and output on the power cord and the ground wire.

The power off signal controller is configured to generate power supply signals used for controlling power supply and power off of the lamp bead chipset. In general, the power supply of the lamp bead chipset is a direct current. That is, the power supply signals have alternating high and low levels and different high level widths.

The power off signal controller includes a direct current power supply, an NMOS transistor of a controllable switch, and a control circuit. The direct current power supply is connected to the power cord of the lamp bead chipset. A control end of the NMOS transistor is connected to the control circuit. An output end of the NMOS transistor is connected to the ground wire of the lamp bead chipset.

Embodiment 5

A direct current power supply in a power off signal controller can be a direct current converted from an alternating current, or directly a direct current power supply. An output power supply can be an about 155v or 310v high-voltage direct current, or a 3v, 5v, or 6v low-voltage direct current. A control circuit is a microcontroller chip U1 in the prior art. A control signal is output to control the subsequent NMOS transistor. The chip model is not required to be specified. Different general MCUs can be used.

During a high voltage application, a colored lamp device according to the present invention is as shown in FIG. 1. A colored lamp device 100 includes connected power off signal controller 101 and lamp bead chipsets 102 which are connected in series or in parallel and are selected from the first row of lamp bead chipsets L1 112, . . . , LY 114, and the last row of lamp bead chipsets LX 113, . . . , LZ 115. The lamp bead chipsets L1, . . . , LY, and LX, . . . , LZ are package forms of the lamp bead chip with a housing.

The power off signal controller 101 is configured to generate power supply signals used for controlling power supply and power off of the lamp bead chipset, and includes a bridge rectifier U2 104 which is used for converting an alternating current into a direct current and has an input of 110v or 220v AC, and an output of about 155v or 310v direct current. A step-down unit 106 is configured to convert an input high voltage into a low voltage for outputting. An input of 155v or 310v is converted into 15v or 5v, etc. A microcontroller chip U1 108 is used as a control circuit used for controlling a switch of the NMOS transistor. Pins VDD and GND of the chip are a positive electrode and a negative electrode of U1, respectively. A pin P12 is an output signal pin or a standard IO interface. The pin outputs the control signal to control on or off of the subsequent NMOS transistor. The chip model is not required to be specified. Different general MCUs can be used.

An alternating current signal AC110V or 220V is input. An alternating current signal is connected to one end of a fuse F1 103, and the other end of the alternating current signal and the other end of the fuse F1 103 are connected to ACs on both ends of the bridge rectifier U2 104. V+ of the bridge rectifier U2 104 is connected to a power cord (i.e., a positive electrode) of the first row of lamp bead chipsets L1 112, . . . , LY 114 of the lamp bead chipset 102. V− of the bridge rectifier U2 104 is connected to all direct current ground wires GND of the circuit. V+ of the bridge rectifier U2 104 is connected to a positive electrode of a capacitor C1 105. V− of the bridge rectifier U2 104 is connected to a negative electrode of the capacitor C1 105. V+ of the bridge rectifier U2 104 is connected to one step-down unit 106 to VDD of the microcontroller chip U1 108 for supplying power. VDD of the microcontroller chip U1 108 is connected to one end of a capacitor C3 107. GND of the microcontroller chip U1 108 is connected to the other end of the capacitor C3 107. An output end P12 of the microcontroller chip U1 108 is connected to one end of a resistor R1 109. The other end of the resistor R1 109 is connected to a base of an NMOS transistor Q1 110. A source of the NMOS transistor Q1 110 is connected to a ground wire GND. The ground wire (i.e., a negative electrode) of the last row of lamp bead chipsets LX 113, . . . , LZ 115 of the lamp bead chipset 102 is connected to a drain of the NMOS transistor Q1 110. The drain of the NMOS transistor Q1 110 is connected to one end of a capacitor C2 111. The other end of the capacitor C2 111 is connected to GND.

In the circuits above, the capacitor C1 is used for filtering and stabilizing voltage. The capacitor C3 is used for carrying out high frequency filtering. The resistor R1 and a base current limiting resistor of the NMOS transistor are used for protecting. The capacitor C2 is used for eliminating high frequency interference.

The working principle of the colored lamp device 100 is: when a voltage at the output end of the microcontroller chip U1 108 is 0, the NMOS transistor Q1 110 is in an off state, and no current is generated in the circuit of the lamp bead chipset 102. When the voltage at the output end of the microcontroller chip U1 108 is not 0, the NMOS transistor Q1 110 is turned on, which is equivalent to connecting to the lamp bead chipset 102 in series, and a current is generated in the circuit of the lamp bead chipset 102. The lamp bead chipset 102 completes the power-on process. When the microcontroller chip 108 is turned on, and the NMOS transistor is turned off, the lamp bead chip set 102 switches between power supply and power off.

During a low voltage application, with reference to FIG. 2, a colored lamp device 200 according to the present invention, including connected power off signal controller 201 and lamp bead chipsets 202 which are connected in series or in parallel and are selected from the first row of lamp bead chipsets L1 212, . . . , LY 214. A direct current signal is input. A positive electrode of the direct current signal is connected to VDD of a microcontroller chip U1 208 for supplying power, and is connected to a power cord (i.e., a positive electrode) of the first row of lamp bead chipsets L1 212, . . . , LY 214 of the lamp bead chipset 202. VDD of the microcontroller chip U1 208 is connected to one end of a capacitor C3 207. GND of the microcontroller chip U1 208 is connected to the other end of the capacitor C3 207. An output end P12 of the microcontroller chip U1 208 is connected to one end of a resistor R1 209. The other end of the resistor R1 209 is connected to a base of an NMOS transistor Q1 210. A source of the NMOS transistor Q1 210 is connected to a ground wire GND. A ground wire (i.e., a negative electrode) of the first row of lamp bead chipsets L1 212, . . . , LY 214 of the lamp bead chipset 202 is connected to a drain of the NMOS transistor Q1 210. The drain of the NMOS transistor Q1 210 is connected to one end of a capacitor C2 211. The other end of the capacitor C2 211 is connected to GND.

The low voltage application is similar to the high voltage step-down application in FIG. 1. The difference is that: a direct current voltage (selected from 3v, 5v, 6v, etc.) is input for directly supplying power to the lamp bead chipset and the microcontroller chip U1.

In conclusion, the working principle of a colored lamp device in the present invention is: when a microcontroller chip U1 is turned on, and an NMOS transistor is turned off, a lamp bead chipset switches between power supply and power off. A driver IC unit of the lamp bead chipset records the time of the high level width of the power supply before power off. The value recorded during short power off does not disappear. After being recorded for several times (the times can be selected according to the coding bit), the widths are decoded (it is determined, according to the power supply high level widths, that the code is 0, 1, or invalid), and then the obtained code values are achieved according to the colored lamp effects corresponding to a code to control on and off of an LED chip to achieve different colored lamp change effects.

Embodiment 6

Accordingly, the present invention further provides a control method for a colored lamp device, including the following process:

At step one, a power off signal controller generates power supply signals having alternating high and low levels and different high level widths, and loads the power supply signals onto a power cord and a ground wire.

At step two, a driver IC unit records the high level width in the power supply period and memorizes the previously recorded high level width in the power off period according to changes in power supply and power off on the power cord and the ground wire.

At step three, after recording the high level width of a preset coding bit for corresponding times, the driver IC unit decodes the high level widths to obtain a code value of the corresponding bit.

At step four, the driver IC unit controls, according to a colored lamp effect corresponding to the code value, the display state of LED chips in an LED lamp set to achieve the colored lamp effects.

Embodiment 7

Figure 6:
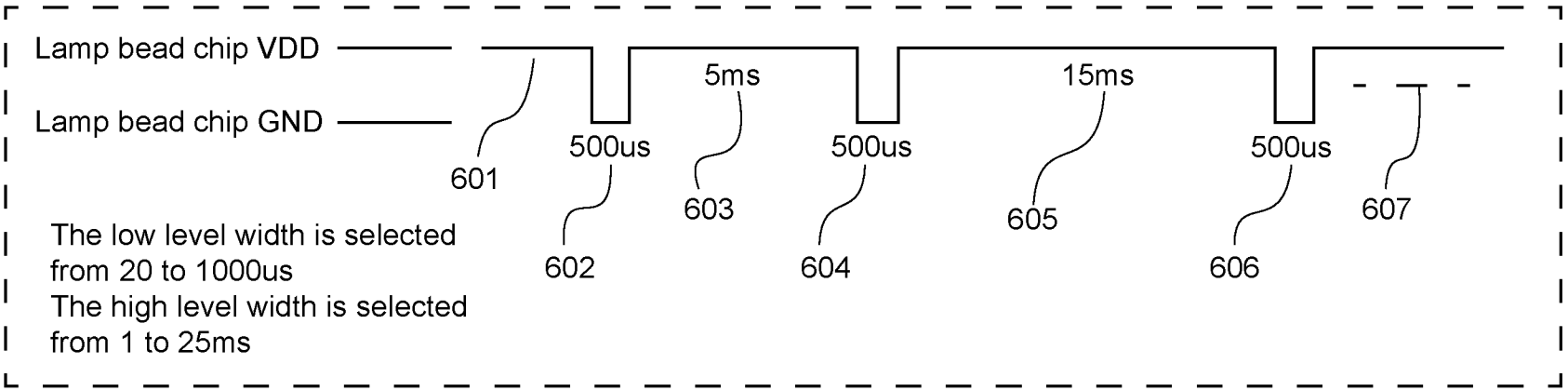
FIG. 6 is a coding diagram of a power supply signal of the lamp bead chipset.

The working principle of a colored lamp device of the present invention is explained below in multiple embodiments:

In one embodiment, with reference to FIG. 6, when being set as 5 ms (such as a waveform 603), the power supply high level width is decoded into 0. When being 15 ms (such as a waveform 605), the power supply high level width is decoded into 1. When being greater than 25 ms or less than 2 ms, the power supply high level width is an invalid code. The time when a lamp bead chipset is powered off is 500 us (such as waveforms 602, 604, 606). Determination of a code value (i.e., decoding) is controlled by the interior of a driver IC unit. The range of the code value can be adjusted. The code value in the figure is two-bit, i.e., 01. Similarly, waveform diagrams of 7-bit code, 8-bit code, 10-bit code, 12-bit code, 14-bit code, etc. can be known.

Figure 7:
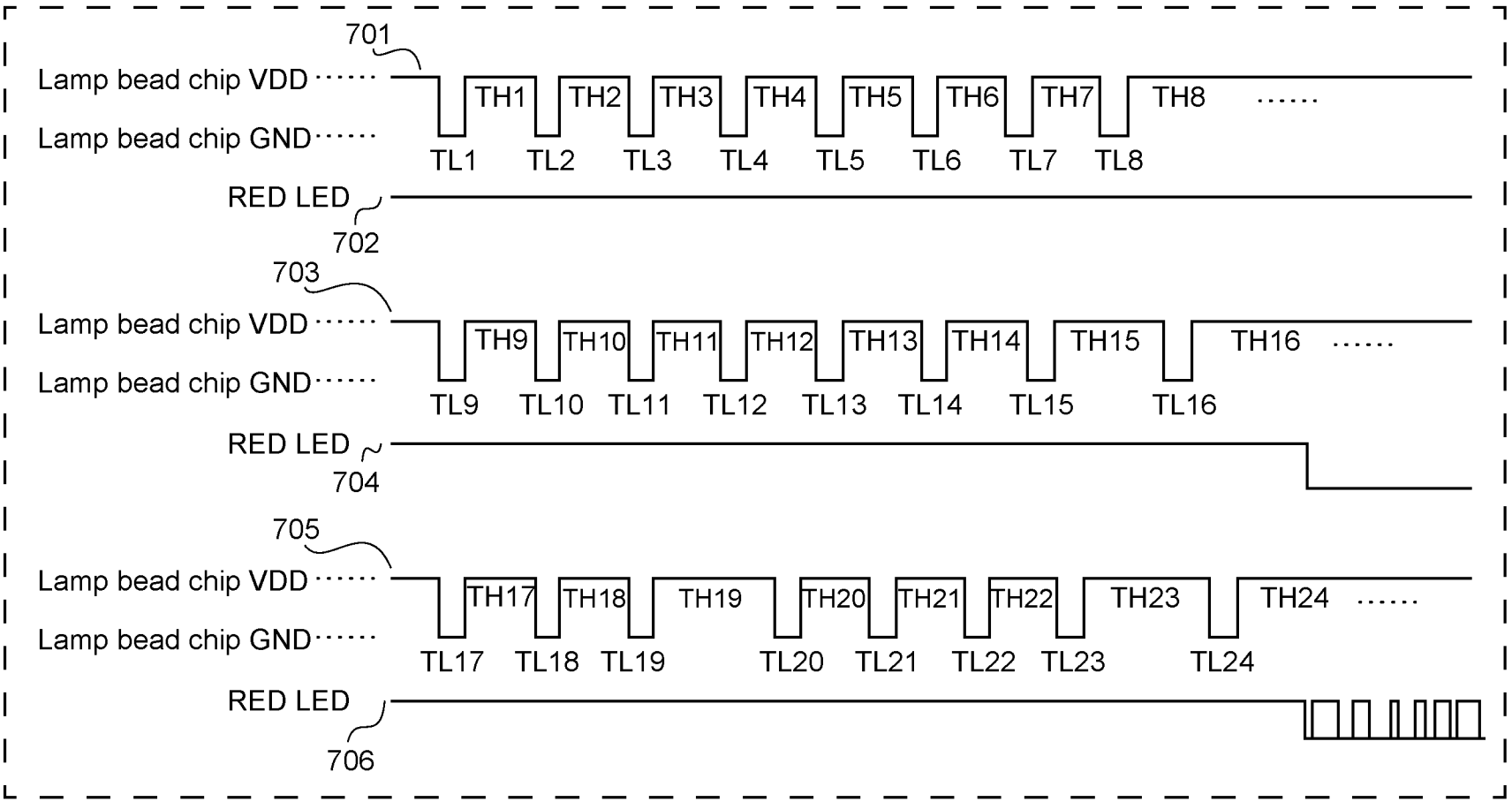
FIG. 7 is a diagram where the lamp bead chipset inputs a power supply signal and a driver IC outputs a waveform.

In one embodiment, for example, a colorful device of 7-bit code is achieved. FIG. 7 shows three frames of complete data codes: a code corresponding to one colored lamp effect is bit[6:0]=0000000 code. A power supply and power off signal controller (101) controls a voltage waveform 701 between a power cord and a ground wire on a lamp bead chipset as TL1=TL2=TL3=TL4=TL5=TL6=TL7=TL8=500 us, and TH1=TH2=TH3=TH4=TH5=TH6=TH7=5 ms. After the driver IC unit 301 completely decodes, a bit[6:0]=0000000 code is obtained. Therefore, the driver IC unit closes all outputs. For example, when a waveform 702 is RA2 (connected to a negative electrode of a RED LED chip), all high level waveforms are output. The same applies to other output pins. LEDs in an LED lamp set 308 do not emit light, and are static off.

When a voltage waveform 703 is TL9=TL10=TL11=TL12=TL13=TL14=TL15=TL16=500 us, TH9=TH10=TH11=TH12=TH13=TH14=5 ms, and TH15=15 ms, after the driver IC unit 301 completely decodes, a bit[6:0]=0000001 code is obtained. Therefore, RA2 is controlled to output a low level. For example, when a waveform 704 in the figure is RA2 (connected to a negative electrode of a RED LED chip), a high waveform is output, and then a low waveform is output (a high level is output before decoding, and a low level is output after decoding). A red LED 310 in the LED lamp set 308 is lighted up, and is static red. Other speeds and other colors may be deduced by analogy.

When a voltage waveform 705 is TL17=TL18=TL19=TL20=TL21=TL22=TL23=TL24=500 us, TH17=TH18=TH20=TH21=TH22=5 ms, and TH19=TH23=15 ms, after the driver IC unit 301 completely decodes, a bit[6:0]=0010001 code is obtained. Therefore, the driver IC unit 301 outputs one waveform with a PWM output. For example, when a waveform 706 in the figure is RED LED, a high waveform is output, and then a group of PWM waveforms are output. A red LED 310 in the LED lamp set 308 is lighted up to obtain the red fading effect having the cycle of 8 s. Other speeds and other colors may be deduced by analogy. The PWM waveform is a waveform with a varying duty ratio. For example, a duty ratio of 1:255 high/low, that is, a high duty ratio of 1, and a low duty ratio of 255 are output, and the cycle is 256; 256-level duty ratio changes can be realized. Outputs of different duty ratios can control the luminance of the LED chip to be different.

Embodiment 8

Figure 8:
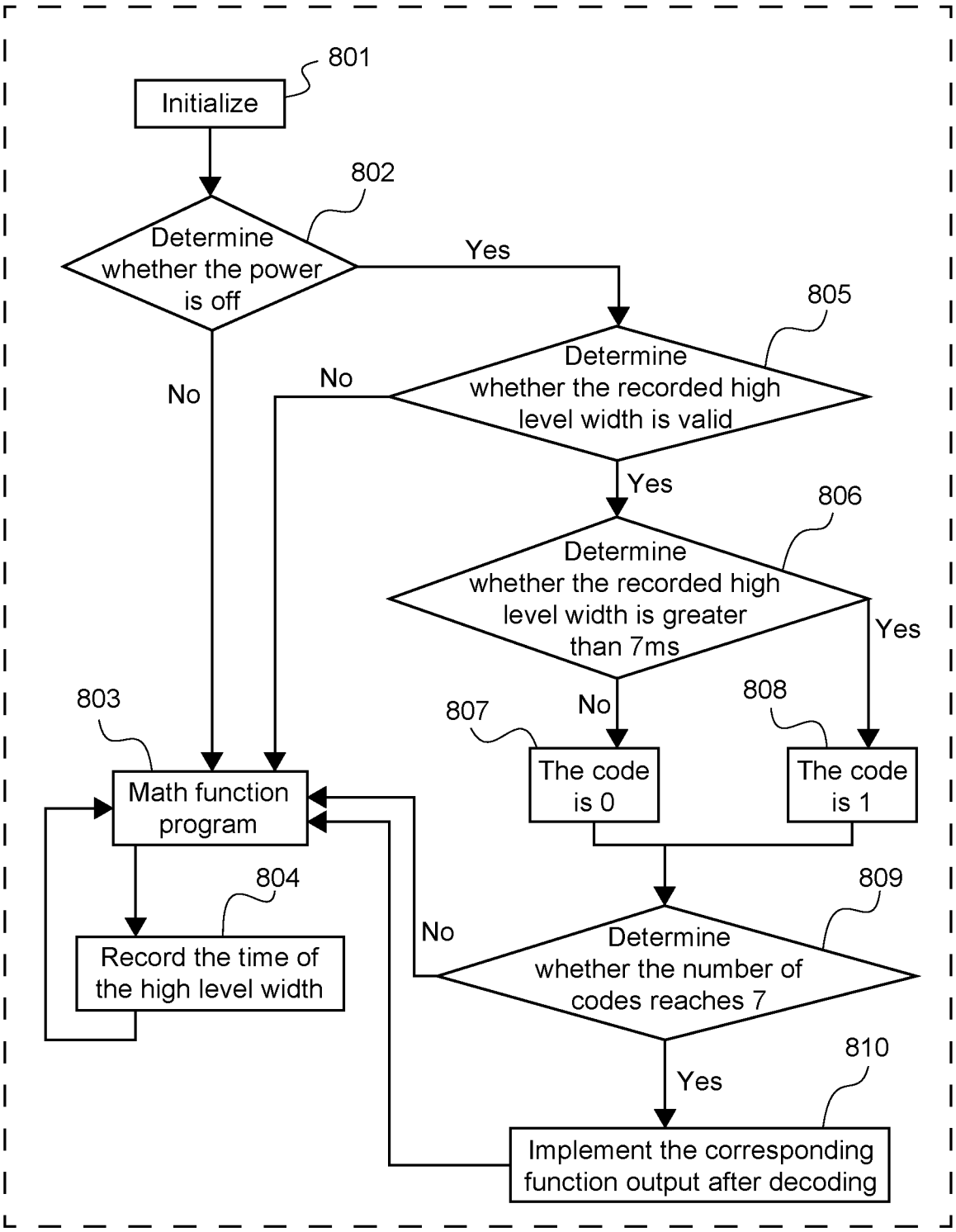
FIG. 8 is a decoding workflow of the driver IC.

In the embodiment, 7-bit code is taken as an example to describe the detailed decoding working process of a driver IC unit, i.e., the detailed decoding working process of the embedded software of an MCU control unit. With reference to FIG. 8, the following process is included:

At step 801, a system is initialized, for example, IO ports of the MCU control unit are initialized.

At step 802, it is determined whether the connected power is off; if yes, step 805 is implemented; if not, step 803 is implemented.

At step 803, a main function program of the system is executed, for example, the lamp bead pattern is realized.

At step 804, the time of the high level width is recorded.

At step 805, it is determined whether the recorded high level width is valid; if yes, step 806 is implemented; if not, step 803 is implemented.

At step 806, it is determined whether the recorded high level width is greater than a threshold 7 ms; if yes, step 808 is implemented; if not, step 807 is implemented.

At step 807, the high level width is decoded into 0 code.

At step 808, the high level width is decoded into 1 code.

At step 809, it is determined whether the number of codes reaches 7; if yes, the corresponding function output is achieved after decoding; if not, step 803 is implemented.

The beneficial effects of the present invention are as follows: according to a colored lamp device in the present invention, several power supply high level widths on the power cord and the ground wire are adjusted to generate codes, so as to achieve different color change effects. The complexity of traces is reduced and the wire costs are saved. The present invention can be applied to different decorative lamps such as high and low voltage strips, water pipe lamps, copper wire lamps, curtain lamps, and net lamps.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the spirit of the amended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification refers to at least one of something selected from the group consisting of A, B, C . . . and N, the text should be interpreted as requiring only one element from the group, not A plus N, or B plus N, etc.

What is claimed is:

1. A lamp bead chipset, comprising a power cord and a ground wire which are led out, a driver IC unit, and an LED lamp set constituted by one or more LEDs, wherein the power cord and the ground wire are respectively connected to the driver IC unit, and an output end of the driver IC unit is connected to the LED lamp set;

the power cord and the ground wire are configured to load power supply signals having alternating high and low levels and different high level widths, so that the driver IC unit switches between power supply and power off, the driver IC unit is configured to control, according to the power supply signals having several different high level widths and output on the power cord and the ground wire, record the high level width of a preset coding bit for corresponding times, and then decode the high level widths to obtain a code value of the corresponding bit; and the driver IC unit is further configured to control, according to a colored lamp effect corresponding to the code value, the display state of each LED in an LED lamp set to achieve the colored lamp effects.

2. The lamp bead chipset according to claim 1, wherein the driver IC unit comprises a voltage stabilizing unit, a discharge resistor, an MCU control unit, a power off memory unit, a PWM unit, and a luminance driver circuit;

the voltage stabilizing unit is configured to perform voltage stabilizing on a power supply output by the power cord and the ground wire so as to supply power to the driver IC unit and the LED lamp set;

the discharge resistor is connected between the power cord and the ground wire, and is configured to rapidly discharge the power supply in a power off period;

the power off memory unit is configured to memorize, in the power off period, a high level width in a power supply period which is previously recorded;

the MCU control unit is configured to record the high level width in the power supply period, and output corresponding different drive signals to the PWM unit according to the several different high level widths;

the PWM unit is configured to output corresponding different PWM waveform drive signals according to the different drive signals; and the luminance driver circuit is configured to output control signals to the LED lamp set according to the different PWM waveform drive signals to control the display state of each LED in the LED lamp set.

3. The lamp bead chipset according to claim 1, wherein the driver IC unit is further configured to:

in response to a power supply and power off switch state formed by alternating high and low levels on a power cord and a ground wire, record the current high level width in a power supply period, and memorize the previously recorded high level width in a power off period.

4. The lamp bead chipset according to claim 1, wherein the power off time ranges from 20 us to 1 ms, and the power supply time ranges from 1 ms to 25 ms.

5. The lamp bead chipset according to claim 1, wherein at the beginning of power supply, if a power supply high level width change signal is not received temporarily, a test mode runs to make the LED chipset emit white light or other combinations.

6. The lamp bead chipset according to claim 1, wherein the coding bit comprises 7-bit code, 8-bit code, 10-bit code, 12-bit code, or 14-bit code.

7. The lamp bead chipset according to claim 1, wherein the decoding the high level widths comprises:

determining, according to the power supply high level widths, that code is 0, 1, or invalid.

8. A colored lamp device, comprising a power off signal controller and several lamp bead chipsets connected in series, in parallel or in series and in parallel, wherein the lamp bead chipset is the lamp bead chipset according to claim 1;

an output end of the power off signal controller is connected to the lamp bead chipset by means of a power cord and a ground wire;

the power off signal controller is configured to generate power supply signals having alternating high and low levels and different high level widths, and load the power supply signals onto the power cord and the ground wire so that the lamp bead chipset switches between power supply and power off, and the lamp bead chipset is configured to achieve various colored lamp effects according to the power supply signals having several different high level widths and output on the power cord and the ground wire.

9. The colored lamp device according to claim 8, wherein the power off signal controller comprises a direct current power supply, an NMOS transistor, and a control circuit for controlling an NMOS switch; the direct current power supply is connected to the power cord of the lamp bead chipset; a base of the NMOS transistor is connected to the control circuit; a drain of the NMOS transistor is connected to the ground wire of the lamp bead chipset; a source of the NMOS transistor is grounded; and a capacitor is connected in parallel between the drain and the source of the NMOS transistor.

10. A control method for the colored lamp device according to claim 8, comprising the following process:

a power off signal controller generates power supply signals having alternating high and low levels and different high level widths, and loads the power supply signals onto a power cord and a ground wire;

a driver IC unit records the current high level width in a power supply period according to a power supply and power off switch state formed by the alternating high and low levels on the power cord and the ground wire, and memorizes the previously recorded high level width in a power off period;

after recording the high level width of a preset coding bit for corresponding times, the driver IC unit decodes the high level widths to obtain a code value of the corresponding bit; and the driver IC unit controls, according to a colored lamp effect corresponding to the code value, the display state of each LED chip in an LED lamp set to achieve the colored lamp effects.

* * * * *